US006430855B1

(12) United States Patent
Gertz et al.

(10) Patent No.: US 6,430,855 B1
(45) Date of Patent: Aug. 13, 2002

(54) SIGN STAND WITH FLEXIBLE UPPER MAST PORTION

(75) Inventors: David C. Gertz, San Clemente; Jack H. Kulp, San Juan Capistrano, both of CA (US)

(73) Assignee: Traffix Devices, Inc., San Clemente, CA (US)

( * ) Notice: Subject to any disclaimer, the term of this patent is extended or adjusted under 35 U.S.C. 154(b) by 0 days.

(21) Appl. No.: 09/245,581

(22) Filed: Feb. 5, 1999

(51) Int. Cl.[7] ..... G09F 15/00
(52) U.S. Cl. ..... 40/607; 40/608; 248/548
(58) Field of Search ..... 40/608, 607; 248/548, 248/900

(56) References Cited

U.S. PATENT DOCUMENTS

| | | | | |
|---|---|---|---|---|
| 1,582,931 A | * | 5/1926 | Kennedy | 40/608 X |
| 3,933,117 A | | 1/1976 | Maietta | |
| 4,032,248 A | | 6/1977 | Parduhn et al. | 404/10 |
| 4,061,435 A | | 12/1977 | Schmanski et al. | 404/10 |
| 4,092,081 A | | 5/1978 | Schmanski | 404/10 |
| 4,249,832 A | | 2/1981 | Schmanski | 404/6 |
| 4,288,053 A | * | 9/1981 | Sarkisian | 40/607 X |
| 4,498,657 A | | 2/1985 | Werner | |
| 4,511,281 A | | 4/1985 | Schmanski | 404/10 |
| 4,522,530 A | | 6/1985 | Arthur | 404/10 |
| 4,571,118 A | | 2/1986 | Schmanski | 404/10 |
| 4,572,473 A | * | 2/1986 | Seely | 40/608 X |
| 4,674,432 A | | 6/1987 | Schmanski | 116/63 P |
| 4,676,015 A | * | 6/1987 | Stoudt | 40/608 |
| 4,863,138 A | * | 9/1989 | Dicke et al. | 40/608 X |
| 4,893,455 A | * | 1/1990 | Hughes | 248/548 X |
| 5,181,695 A | | 1/1993 | Arthur | |
| 5,438,782 A | * | 8/1995 | Belobraydich et al. | 40/607 X |
| 5,502,909 A | | 4/1996 | Rabkin | 40/603 |
| 5,611,509 A | | 3/1997 | Kulp et al. | |
| 5,624,092 A | | 4/1997 | Kulp et al. | |
| 5,738,317 A | * | 4/1998 | Hugron | 40/607 X |
| 5,836,558 A | | 11/1998 | Kulp et al. | |

OTHER PUBLICATIONS

Keeping current with NCHRP 350; ATSSA Signal; p. 14, fall 1998.

Crash Worthiness of Workzone Appurtenances; http://www.ohs.fhwa.dot.gove/design/ra.htm; Feb. 1, 1999.

Requirements for Crash Testing of Work Zone Devices (NCHRP 350); http://www.atssa.com/nchrp350.htm; Feb. 1, 1999.

* cited by examiner

*Primary Examiner*—Jack Lavinder
*Assistant Examiner*—William L. Miller
(74) *Attorney, Agent, or Firm*—Stout, Uxa, Buyan & Mullins, LLP; Donald E. Stout

(57) ABSTRACT

A sign stand has a mast with a flexible upper portion. The flexible upper portion of the mast inhibits the mast from piercing a windshield of a vehicle when the sign stand is struck by the vehicle. The sign stand may have a sign mounted on the mast flexible upper portion. Additionally, a top end of the mast flexible upper portion extends beyond a top edge of the sign. The mast flexible upper portion may have other items attached to it, such as a flag holder, a light mounting bracket, a light, or sign mounting brackets. The sign mounted to the flexible upper mast may be metal, such as aluminum, composite materials, or fabric. The mast also has a lower portion that is connected to a support stand. The mast lower portion may be flexibly connected to the support stand. The mast may be made up of two or more parts. The mast may be telescopic. The upper and lower portions of the mast may be in a telescopic relationship. The flexible upper portion of the mast may telescope from an interior space of the mast lower portion. The relationship may be other than telescopic and at least a portion of the flexible mast upper portion may be disposed inside the mast lower portion. The two portions of the mast may be mechanically attached.

33 Claims, 4 Drawing Sheets

SIGN STAND WITH FLEXIBLE UPPER MAST PORTION

BACKGROUND OF THE INVENTION

1. Field of the Invention

This invention relates to traffic safety devices and, more specifically, sign stands.

2. Description of the Related Art

Sign stands are used for numerous purposes, such as warning about traffic conditions, announcing work areas, posting speed limits, delineating traffic and the like. The signs mounted to the sign stands may reach four feet in diameter. The signs may also be mounted on permanent or transportable sign stands with the bottom of the sign being seven feet or more above the ground.

When using the sign stands outside, they are subjected to wind and vacuums created by passing vehicles. The sign acts as a sail and catches the wind. If the sign stand were rigid, the wind on the sign would create enormous forces against the stand.

The prior art discloses sign stands that permit the wind to spill off of the sign. An example of such a sign stand is disclosed in U.S. Pat. No. 4,498,657 to Werner entitled "Sign Standard For Supporting And Displaying A Sign," which is incorporated herein by reference in its entirety. Werner discloses a rigid mast that is interrupted by a spring assembly. The prior art also discloses inserting a spring assembly between the rigid mast and the bottom support or base. In either case, the spring assembly flexes to permit wind to spill off of the sign mounted on the rigid mast. By being able to spill the wind, the sign stand may be smaller, lighter, easier to handle and transport than a similar stand designed to withstand the wind.

The sign stands are often hit by errant vehicles and need to be designed to withstand sufficiently the impact. Ideally, the sign stand withstands sufficiently the impact if it may be simply and cost effectively repaired and placed back into service.

When a sign stand is impacted by an errant vehicle, the rigid mast of the sign stand severs typically at the bottom of the mast. The impact and severing of the mast results in the mast incurring a polar momentum with the top of the rigid mast rotating down toward the vehicle with a great force. The combination of the downwardly rotating rigid mast top and the moving vehicle may result in the mast top piercing the windshield and injuring passengers in the vehicle.

In the Fall 1998 issue of *SIGNAL,* which is a biannual publication of the American Traffic Safety Services Association (ATSSA), it is reported that existing portable sign systems have not been accepted by FHWA's Office of Engineering. The ATSSA has stated that it is paramount that the traffic safety industry works toward acceptable portable sign systems. To be accepted by the FHWA's Office of Engineering, sign stand parts do not penetrate the occupant compartment of the errant vehicle that strikes the sign stand.

Thus, there is a need for a sign stand that has a mast with a reduced chance of piercing a windshield after being struck by a vehicle.

SUMMARY OF THE INVENTION

In an aspect of the invention, a sign stand has a mast with a flexible upper portion. In a further aspect of the invention, at least one end of a sign is mounted to the mast flexible upper portion. In a still further aspect of the invention, a top end of the mast flexible upper portion extends beyond a top edge of the sign.

Aspects of the invention may have items besides signs attached to the flexible upper portion of the mast, such as a flag holder, a light mounting bracket, a light, or sign mounting brackets.

In aspects of the invention, the sign may be comprised of metal, composite materials, or fabric. The metal sign may be comprised of aluminum.

In an aspect of the invention, a mast lower portion is connected to a support stand. In a further aspect of the invention, the mast lower portion is flexibly connected to the support stand base by the use of springs.

In an aspect of the invention, the mast is telescopic. In a further aspect of the invention, the flexible mast upper portion and the mast lower portion are in a telescopic relationship. In a still further aspect of the invention, the flexible mast upper portion telescopes from an interior space of the mast lower portion.

In another aspect of the invention, at least a portion of the flexible mast upper portion is disposed inside the mast lower portion when the mast is in the use or extended position.

In another aspect of the invention, the flexible mast upper portion and the mast lower portion are mechanically attached in the use or extended position and in the storage or collapsed position.

In an aspect of the invention, the mast comprises a rigid lower portion that defines an axis. A distally located tip of the flexible upper portion deflects from 10 to 20 inches from the axis when 16 pounds of force is applied to the tip. In a preferred aspect of the invention, the tip deflection is 10 to 15 inches when 16 pounds of force is applied. In a more preferred aspect of the invention, the tip deflects approximately 15 inches when 16 pound of force is applied. In an aspect of the invention, the tip may deflect between 10 and 20 inches when 16 pounds of force is applied to it. In other aspects of the invention, the tip may deflect 15 inches when a force of between 10 and 20 pounds is applied.

In an aspect of the invention, the flexible upper portion has a modulus of 300,000 to 400,000 psi. In a preferred aspect of the invention, the flexible upper portion has a modulus of approximately 350,000 psi.

In an aspect of the invention, the flexible upper portion comprises polyvinylchloride, polycarbonate, acrylonitrite butadiene styrene or fiber reinforced plastic. In a more preferred aspect of the invention, the flexible upper portion comprises a square tube of polyvinylchloride.

The present invention, together with additional features and advantages thereof, may best be understood by reference to the following description taken in connection with the accompanying illustrative drawings.

DESCRIPTION OF THE PREFERRED EMBODIMENTS

Figure 1:
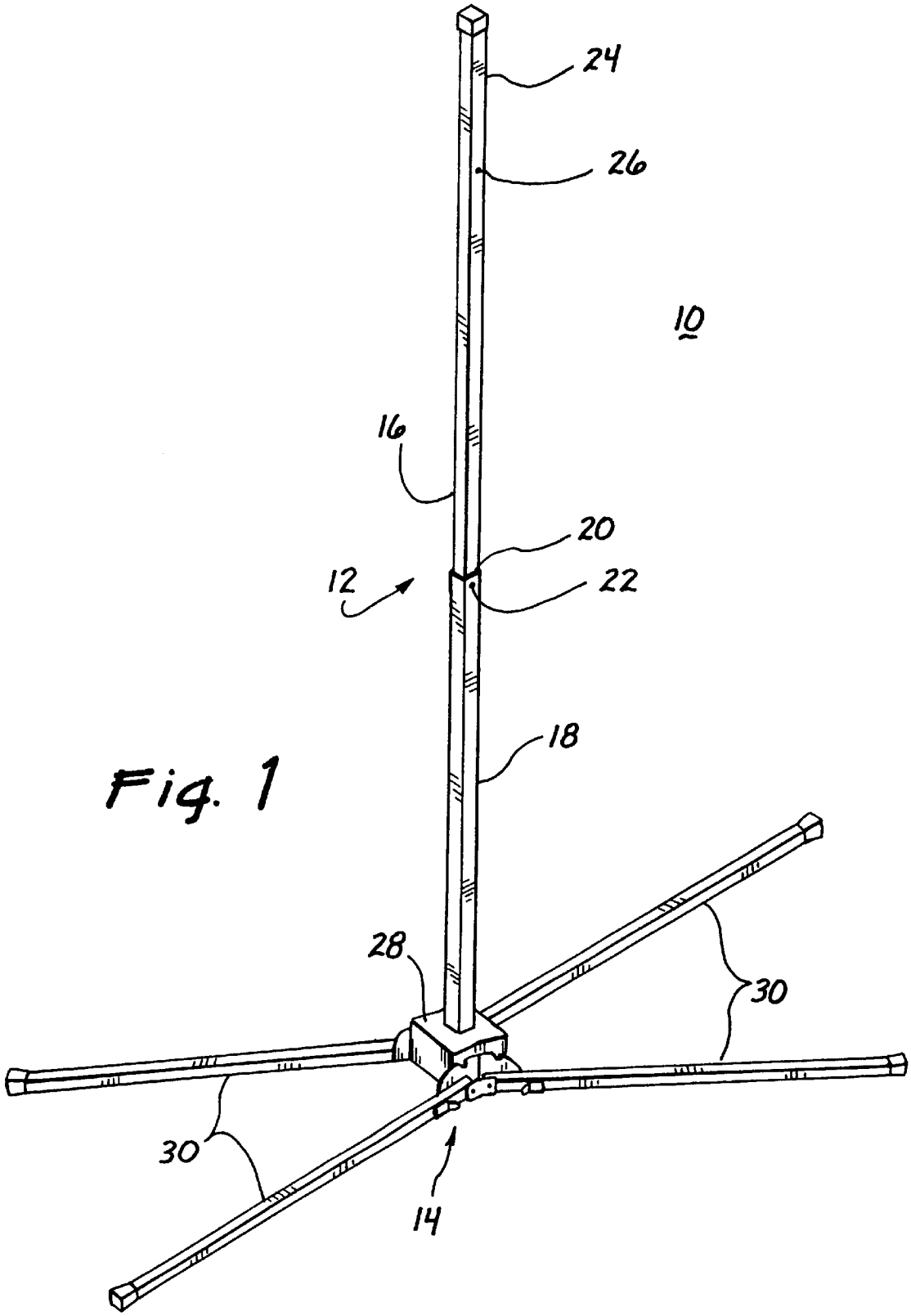
FIG. 1 is a perspective view of a telescoping sign stand in an extended or use position without a sign or a spring assembly according to an embodiment of the invention.

Referring now to the figures, wherein like reference numerals refer to like elements throughout the figures, there is shown a sign stand 10 with a telescopic mast 12 vertically mounted to a support stand 14. The support stand 14 has a quick release mechanism as disclosed in U.S. Pat. No. 5,611,509 to Kulp et al. entitled "Quick Release Mechanism for a Display Stand," and is incorporated herein by reference in its entirety. Other embodiments of the invention may have other types of support stands or may be mounted in an object or the ground.

The telescopic mast 12 in the shown embodiment has a flexible upper portion 16 and a lower portion 18. FIG. 1 shows the mast 12 in an extended or use position, which is the typical position for using the sign stand 10. The flexible upper portion 16 is held in place by a pin apparatus (not shown) in the bottom end 20 of the upper portion that is engaged with a hole 22. Proximate to an upper end 24 of the flexible upper portion 16 is another pin apparatus 26 to secure the upper mast portion 16 in the lower portion 18 when The mast 12 is in the collapsed position (not shown). Having the mast 12 secured in the collapsed position is useful for storage and transportation of the sign stand 10. The support stand 14 comprises a support platform 28 for supportably receiving a lower end of the mast lower portion 18. A plurality of legs 30 are arranged to support the support platform 28, as shown in FIG. 1. The legs 30 are movable between an extended and retracted position for convenient storage and transport, as disclosed in U.S. Pat. No. 5,611, 509 to Kulp et al., which has already been incorporated by reference herein.

In the shown embodiment of the invention, the flexible upper mast portion 16 telescopes out from the interior space (not shown) of the mast lower portion 18. Other embodiments of the invention may have the lower mast portion 18 telescoping out from the interior space (not shown) of the flexible upper portion 16. Other embodiments of the invention may have other mechanical holding apparatuses to secure the telescopic mast 12 in the extended and collapsed positions, such as a spring loaded pin. Other embodiments may also have only a mechanical holding apparatus to secure the mast 12 in the extended position and not the collapsed position. Other embodiments of the invention may have more portions, such that the mast has one or more intermediate portions that mechanically attach the flexible upper portion 16 to the lower portion 18. Other embodiments of the invention may have a non-telescoping mast that has a flexible upper portion mechanically connected to a lower portion, which may be either assembled in the field or prior to arrival at the point of use of the sign stand 10.

Figure 2:
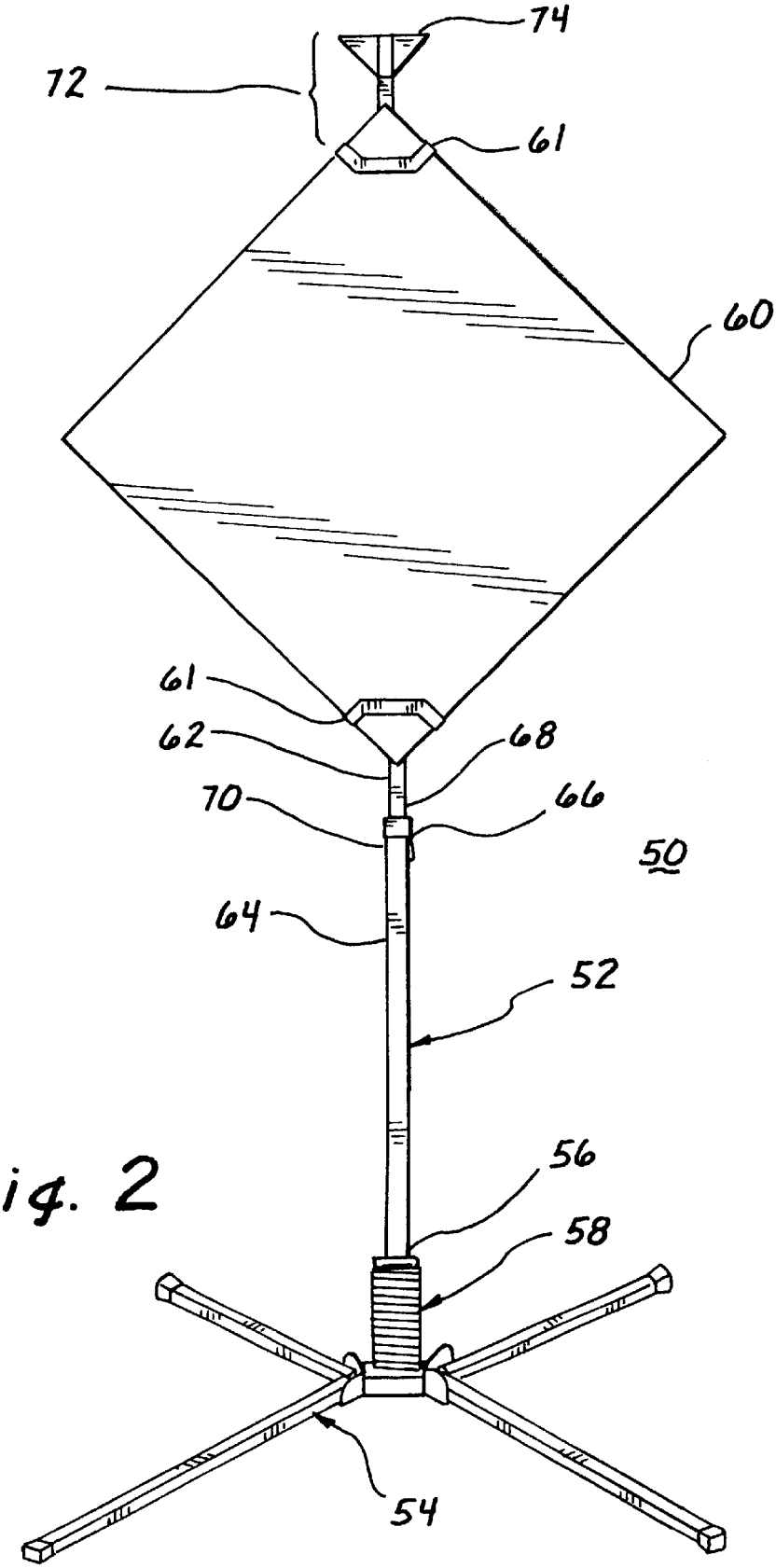
FIG. 2 is a front perspective view of a telescoping sign stand in an extended or use position with a sign and a spring assembly according to an embodiment of the invention.

Referring now to FIG. 2, in another embodiment of the invention, a sign stand 50 has a telescopic mast 52 that is vertically mounted to a support stand 54. Disposed between a bottom end 56 of the mast 52 and the support stand 54 is a spring assembly 58 that provides some flexibility to The sign stand 50. The flexibility enables wind to spill off of a sign 60 mounted to the mast 52 with the aid of two sign mounting brackets 61. In an embodiment of the invention, the brackets 61 are adjustable sign mounting brackets as disclosed in U.S. Pat. Nos. 5,624,092 and 5,836,558, both to Kulp et al., mutually entitled "Adjustable Sign Mounting Brackets", and both are incorporated herein by reference in their entireties. Other embodiments of the invention may use any suitable mounting apparatus to attach the sign 60 to the mast 52.

The telescopic mast 52 of the sign stand 50 has a flexible upper portion 62 and a lower portion 64. The mast 52 is shown in an extended or use position, with a pin and hole arrangement 66 securing an upper portion lower end 68 to a lower portion upper end 70.

Figure 3:
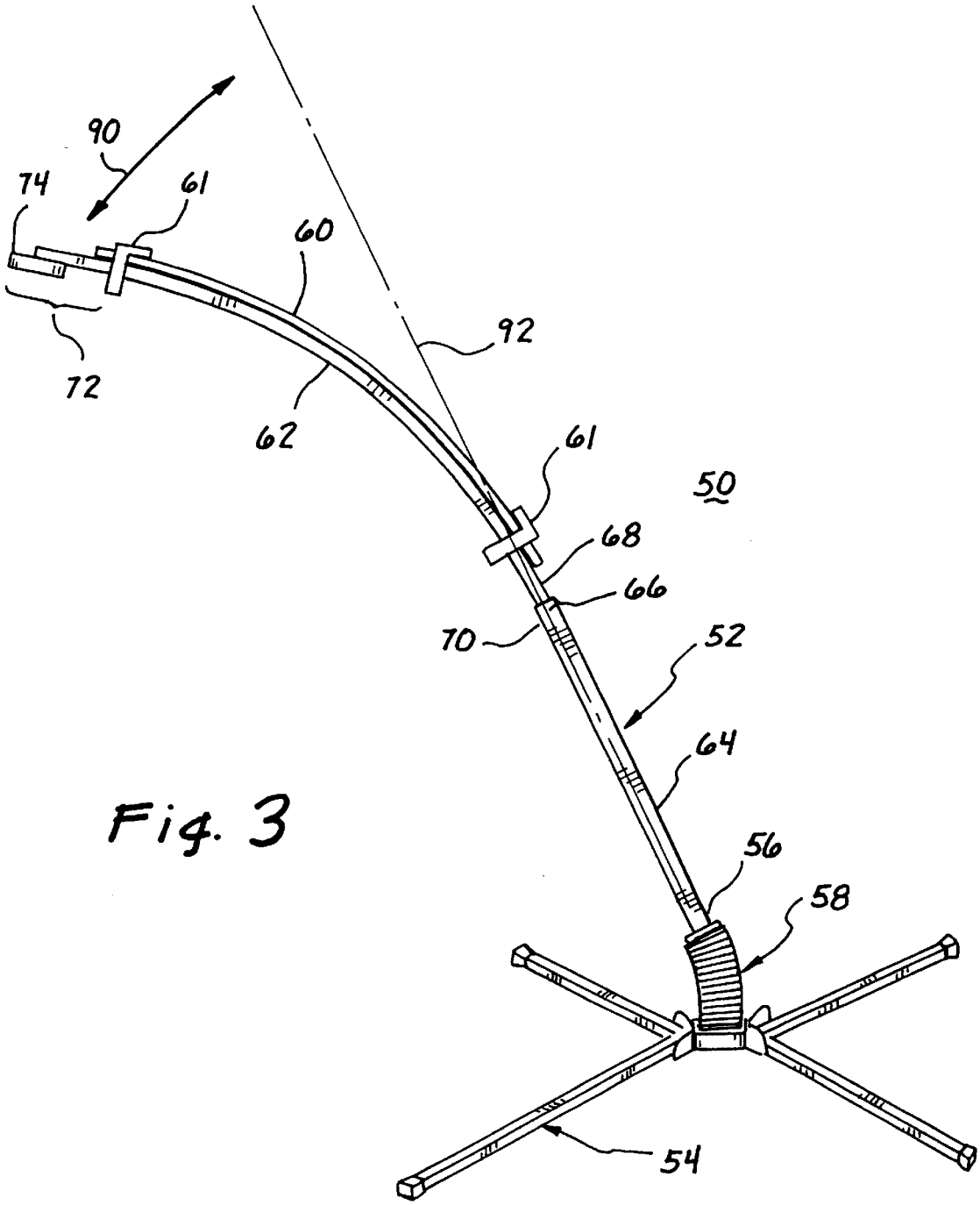
FIG. 3 is a side perspective view of sign stand of FIG. 2 in a flexed position.

Referring now to FIG. 3, the sign stand 50 is shown in a flexed position. The spring assembly 58 is shown bending to the left. The lower portion 64 of the mast 52 is shown straight as it is relatively inflexible. In preferred embodiments of the invention, the lower portion 64 is aluminum or steel. Other embodiments of the invention may have a lower portion fabricated from another material or materials. Still other embodiments of the invention may have a lower portion that is more or less flexible than the square aluminum tube of the preferred embodiment.

Continuing to refer to FIG. 3, the flexible upper portion 62 of the mast 52 is flexed as well as the spring assembly 58. The flexible upper portion 62 is preferably made from 1¼ inch square PVC tubing with ¼ inch thick walls. In the shown embodiment of the invention, the flexible upper portion 62 is a square tube. Other embodiments of the invention may have a flexible upper portion 62 being a tube of another shape, or not be a tube at all, but rather be any suitable flexible member. Other embodiments of the invention may have a mast 52 having a flexible upper portion 62 made of another flexible material, such as polycarbonate, ABS (acrylonitrite butadiene styrene), and FRP (fiber reinforced plastic). Some embodiments of the invention may have multiple masts with flexible upper portions. In a highly preferred embodiment of the invention, the flexible upper portion 62 is made from a material with a modulus of 350,000 psi. In preferred embodiments of the invention, the modulus of the flexible upper portion 62 may range from 300,000 to 400,000 psi.

The flexible upper portion 62 deflects a distance 90 off of an axis 92 of the rigid lower portion 64. In a preferred embodiment of the invention, the overall height of the telescopic mast 52 is 130 inches with the flexible upper portion having a total length of 66 inches and 4" of the upper portion is disposed in the lower portion 64 when the sign stand 50 is in the use position. In the shown and preferred embodiment, a distally located tip 72 of the flexible upper portion 62 is deflected a distance 90 of approximately 15 inches when 16 pounds of force is applied to the tip without the either the upper portion 62 or the lower portion 64 reaching their yield point. Other embodiments of the invention may deflect 15 inches when a force of between 10 and 20 pounds is applied to the tip 72. Other embodiments of the invention may have a flexible upper portion tip 72 that deflects between 10 and 20 inches when 16 pounds of force is applied to it.

In the shown embodiment of the invention, the sign 60 mounted to the mast 52 is also flexed, as may happen with certain signs such as aluminum signs. Signs used in conjunction with the invention may be of any flexible construction, including metal, composite material, and may be a roll-up sign.

Referring now to FIGS. 2 and 3, an upper end 72 of the flexible upper portion 62 extends beyond the sign 60. The benefit of the overall length of the mast 52 is discussed below. Mounted to the upper end 72 is a flag holder 74. Other embodiments of the invention may not have a flag holder mounted to the upper end 72, or may have any other suitable item such as a light mounting bracket.

Figure 4:
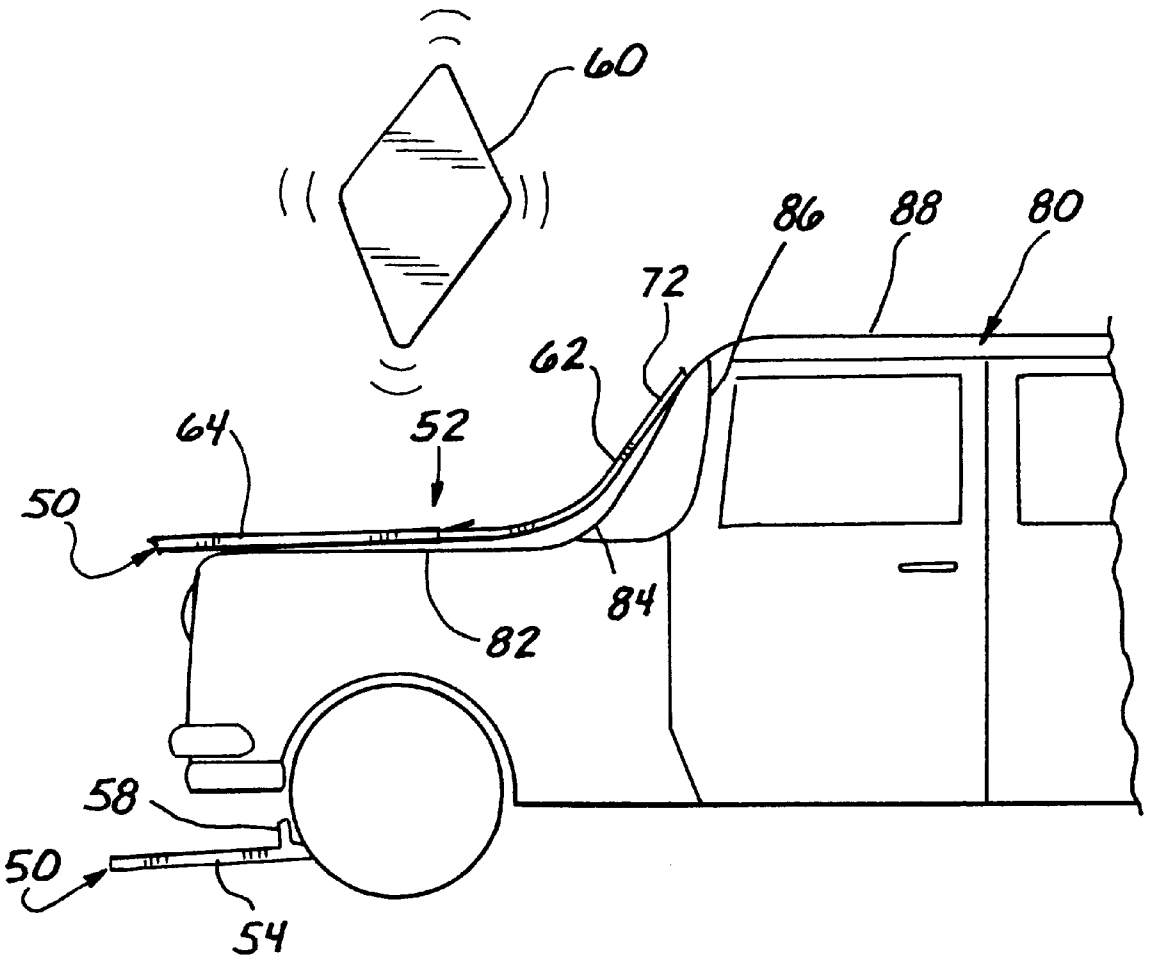
FIG. 4 is an elevation view of the sign stand of FIG. 2 after it has been struck by a vehicle.

Referring now to FIG. 4, the sign stand 50 has been struck by a vehicle 80 and the sign 60 has been stripped from the mast 52. The support stand 54 is under the vehicle 80 and the mast 52 has been severed from the support stand at or above the spring assembly 58. The relatively inflexible lower portion 64 is disposed on the hood 82. The relatively flexible upper portion has flexed and follows the curve 84 of the hood 82 and the wind shield 86. Due to the flexing of the upper portion 62, the polar momentum of the mast 52 dissipates as it collides with the hood 82 and wind shield 86 of the vehicle 80. As a result of the polar momentum dissipation, the mast 52 has a reduced probability of penetrating the wind shield 86 and putting passengers behind the wind shield at risk.

Embodiments of the invention may not have a sign stand 50 that separates upon impact. Embodiments of the invention may have masts 52 of different lengths such that the top end 72 of the mast flexible upper portion 62 strikes the roof 88 of the vehicle 80, thus further inhibiting the mast to pass through the wind shield 86.

Although presently preferred embodiments of the present invention have been described in detail hereinabove, it should be clearly understood that many variations and/or modifications of the basic inventive concepts herein taught, which may appear to those skilled in the pertinent art, will still fall within the spirit and scope of the present invention, as defined in the appended claims.

What is claimed is:

1. A portable sign stand for supporting a traffic safety sign, comprising:

a base comprising a support platform and a plurality of legs supporting said support platform; and a mast upstanding from said support platform, said mast comprising a lower portion and an upper portion wherein said lower portion comprises a first material and said upper portion comprises a second material wherein said first material is more rigid than said second material, so that when said sign stand is subjected to a substantial applied force, said upper portion bends a substantially greaser amount than said lower portion.

2. The portable sign stand as recited in claim 1, wherein said mast upper portion has an upper end which is adapted for attachment to a traffic safety sign.

3. The portable sign stand as recited in claim 1, and further comprising a spring assembly for attaching said mast lower portion to said support platform.

4. The portable sign stand as recited in claim 1, wherein said mast lower portion comprises a rigid metal material.

5. The portable sign stand as recited in claim 4, wherein said rigid metal material comprises aluminum.

6. The portable sign stand as recited in claim 1, wherein said mast upper portion comprises a flexible plastic material.

7. The portable sign stand as recited in claim 1, wherein said mast upper portion comprises polyvinylchloride.

8. The portable sign stand as recited in claim 1, wherein said mast is telescopic.

9. The portable sign stand as recited in claim 8, wherein the mast upper portion and the mast lower portion are in a telescopic relationship relative to one another, and are positionable in either an extended position for deployment or a retracted position for storage or transport.

10. The portable sign stand as recited in claim 9, wherein the mast upper portion telescopes from an interior space of the mast lower portion.

11. The portable sign stand as recited in claim 1, wherein the mast lower portion has a longitudinal axis, and at least a portion of the mast upper portion is coaxially disposed within the mast lower portion.

12. The portable sign stand as recited in claim 1, wherein the mast upper portion and the mast lower portion are mechanically attached to one another.

13. The portable sign stand as recited in claim 1, wherein the mast lower portion has a longitudinal axis, and a distally disposed end of the mast upper portion deflects 10 to 20 inches from said axis when a force of between 10 and 20 pounds is applied to the mast.

14. The portable sign stand as recited in claim 1, wherein the mast upper portion has a modulus of between 300,000 and 400,000 psi.

15. The portable sign stand as recited in claim 1, wherein the mast upper portion comprises one of polyvinylchloride, polycarbonate, acrylonitrite butadiene styrene, and fiber reinforced plastic.

16. The portable sign stand as recited in claim 1, wherein the mast upper portion comprises a square hollow polyvinylchloride tube.

17. The portable sign stand as recited in claim 1, wherein said base is disposed entirely above a ground surface upon which it rests.

18. A sign assembly, comprising:

a portable sign stand comprising a base and a mast upstanding from said base, said mast comprising a lower portion and an upper portion wherein said lower portion comprises a first material and said upper portion comprises a second material wherein said first material is more rigid than said second material, said mast upper portion and said mast lower portion being in a telescopic relationship relative to one another, so that when said sign stand is subjected to a substantial applied force, said upper portion bonds a substantial greater amount than said lower portion; and a sign attached to said mast.

19. The sign assembly as recited in claim 18, wherein a top end of the mast upper portion extends beyond a top edge of the sign.

20. The sign assembly as recited in claim 18, wherein said base comprises a support platform for receiving a lower end of said mast lower portion and a plurality of legs for supporting said support platform.

21. The sign assembly as recited in claim 20, wherein said mast lower portion is flexibly connected to said support platform.

22. The sign assembly as recited in claim 18, wherein the mast upper portion comprises one of polyvinylchloride, polycarbonate, acrylonitrite butadiene styrene, and fiber reinforced plastic.

23. The sign assembly as recited in claim 18, wherein the mast lower portion comprises a rigid metal material.

24. The sign assembly as recited in claim 18, wherein a portion of said upper mast portion is disposed behind said sign.

25. The sign assembly as recited in claim 18, wherein a junction between said lower mast portion and said upper mast portion is disposed beneath said sign.

26. The sign assembly as recited in claim 18, wherein the mast upper portion telescopes from an interior space of the mast lower portion.

27. A sign assembly, comprising:

a portable sign stand comprising a base and a mast upstanding from said base, said mast comprising only a lower portion and an upper portion wherein said lower portion comprises a material and said upper portion comprises a second material wherein said first material is more rigid than said second material, so that when said sign stand is subjected to a substantial applied force, said upper portion bends a substantial greater amount than said lower portion;

a sign member attached to said mast, wherein said sign member does not include any integral shaft portion extending therefrom; and a bracket for attaching said sign member to said upper mast portion.

28. The sign assembly as recited in claim 27, wherein a top end of the mast flexible upper portion extends beyond a top edge of the sign.

29. The sign assembly as recited in claim 27, wherein said mast comprises a support platform for receiving a lower end of said mast lower portion and a plurality of legs for supporting said support platform.

30. The sign assembly as recited in claim 29, wherein said mast lower portion is flexibly connected to said support platform.

31. The sign assembly as recited in claim 27, wherein the mast upper portion and the mast lower portion are in a telescopic relationship relative to one another.

32. The sign assembly as recited in claim 27, wherein the mast upper portion comprises one of polyvinylchloride, polycarbonate, acrylonitrite butadiene styrene, and fiber reinforced plastic.

33. The sign assembly as recited in claim 27, wherein the mast lower portion comprises a rigid metal material.

* * * * *